US005744917A

United States Patent [19]

Kawaharada

[11] Patent Number: 5,744,917

[45] Date of Patent: Apr. 28, 1998

[54] ELECTRON GUN ASSEMBLY FOR A COLOR CATHODE RAY TUBE APPARATUS

[75] Inventor: Takahiro Kawaharada, Fukaya, Japan

[73] Assignee: Kabushiki Kaisha Toshiba, Kawasaki, Japan

[21] Appl. No.: 759,734

[22] Filed: Dec. 6, 1996

[30] Foreign Application Priority Data

| | | | |
|---|---|---|---|
| Dec. 8, 1995 | [JP] | Japan | 7-320654 |
| Sep. 18, 1996 | [JP] | Japan | 8-246477 |
| Oct. 8, 1996 | [JP] | Japan | 8-266443 |

[51] Int. Cl.[6] ..... H01J 29/58

[52] U.S. Cl. ..... 315/382.1; 315/15; 313/414; 313/449

[58] Field of Search ..... 315/14, 15, 382, 315/382.1; 313/414, 449

[56] References Cited

U.S. PATENT DOCUMENTS

| | | | |
|---|---|---|---|
| 5,061,881 | 10/1991 | Suzuki et al. . | |
| 5,212,423 | 5/1993 | Noguchi et al. | 313/414 |
| 5,386,178 | 1/1995 | Son et al. | 315/15 |

*Primary Examiner*—Theodore M. Blum
*Attorney, Agent, or Firm*—Cushman Darby & Cushman, IP Group of Pillsbury Madison & Sutro, LLP

[57] ABSTRACT

In a color cathode ray tube apparatus, three electron beams emitted from cathodes form cross-over points and diverge from the cross-over points, respectively. Each of the diverged electron beams is guided through a first quadruple electron lens, a sub-lens, a second quadruple electron lens, and a main lens to a phosphor screen. The sub-lens has lens power for converging the electron beam. The first quadruple electron lens has first horizontal and vertical lens powers for diverging and converging the electron beam in the horizontal and vertical planes, respectively. The second quadruple electron lens has second horizontal and vertical lens powers for converging and diverging the electron beam in the horizontal and vertical planes, respectively. The main lens has a focusing lens power for focusing the electron beam onto the screen. The first and second horizontal and vertical lens powers and the focusing lens power are varied depending on the deflection of the electron beam. The horizontal lens power of the first quadruple electron lens is varied so as to substantially cancel the horizontal lens power of the sub-lens in the horizontal plane.

14 Claims, 6 Drawing Sheets

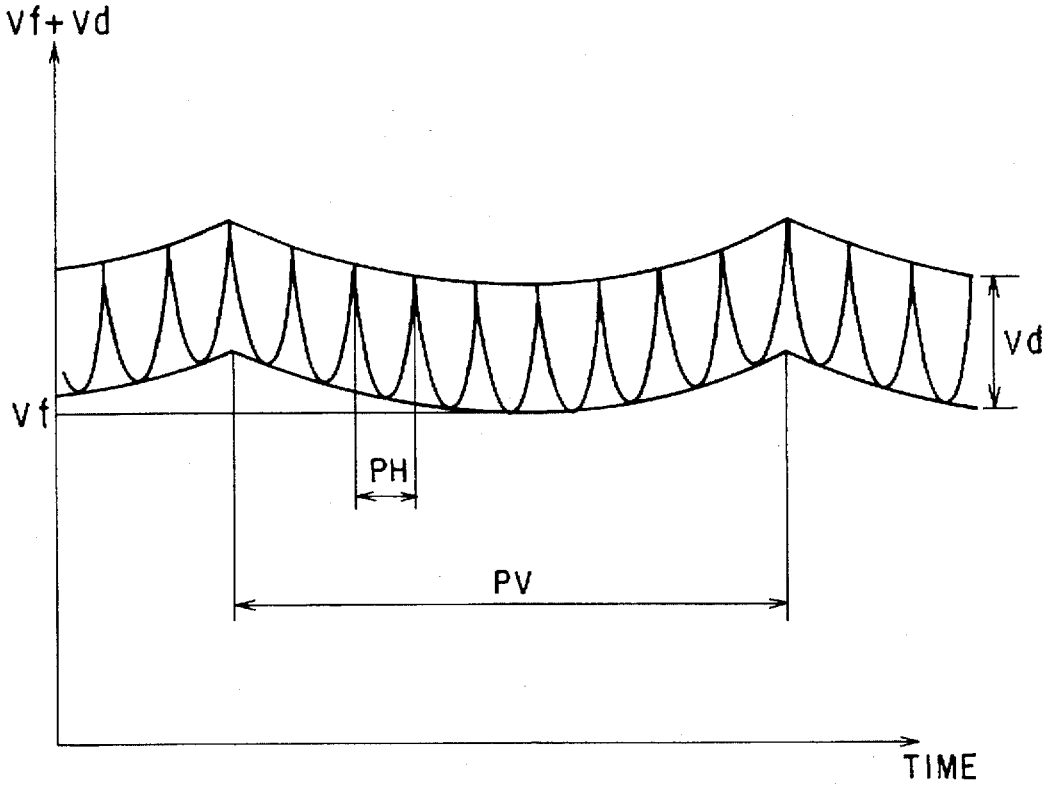
FIG. 7 DYNAMIC VOLTAGE WAVEFORM
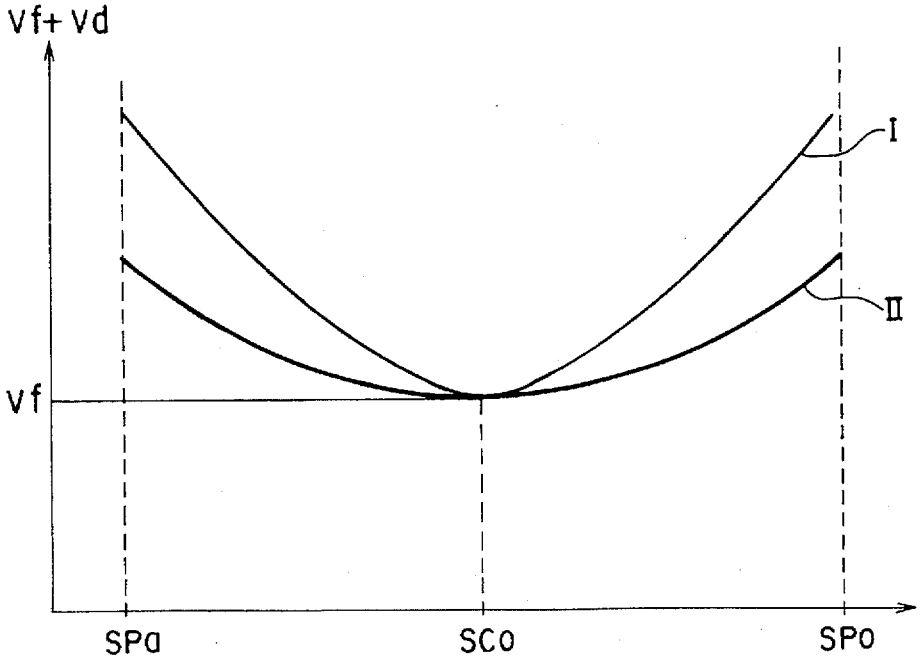
FIG. 8 DYNAMIC VOLTAGE AT EACH PART OF SCREEN

ELECTRON GUN ASSEMBLY FOR A COLOR CATHODE RAY TUBE APPARATUS

BACKGROUND OF THE INVENTION

1. Field of the Invention

The present invention relates to an electron gun assembly for a color cathode ray tube, and particularly, to an electron gun assembly for a color cathode ray tube apparatus that is capable of improving the resolution of an in-line type color cathode ray tube apparatus.

2. Description of the Related Art

In general, a color cathode ray tube apparatus has an envelope consisting of a panel and a funnel. A phosphor screen consisting of three color phosphorus layers is formed on the inner surface of the panel, and a shadow mask is provided on the inner side of the panel, so as to face the phosphor screen. Meanwhile, an electron gun assembly for emitting three electron beams is provided in the neck of the funnel. Further, the three electron beams emitted from the electron gun assembly are deflected by horizontal and vertical deflection magnetic fields generated by a deflection apparatus equipped outside the funnel, so that the phosphor screen is horizontally and vertically scanned, thereby displaying a color image.

As for this kind of color cathode ray tube apparatus, it is a current trend in the field of color cathode ray tubes to use a self-convergence in-line type color cathode ray tube. In particular, this color cathode ray tube employs an in-line type electron gun assembly for emitting three electron beams consisting of a center beam and a pair of side beams which extend on one same horizontal plane and are positioned in one line, and the three electron beams are self-concentrated, while generating a horizontal deflection magnetic field of a pin-cushion type and a vertical deflection magnetic field of a barrel type, by means of a deflection device.

Various structures have been proposed for the electron gun assembly for emitting three electron beams disposed in line. An electron gun of a QPF (Quadra Potential Focus) type double focus method is an example of such a gun assembly. As shown in FIG. 1, this electron gun assembly comprises three cathodes K disposed in line in the horizontal direction or H-axis direction, first to fourth grids G1 to G4 disposed in this order from in the direction from the cathodes toward a phosphor screen, a fifth grid G5 divided into first and second segment electrodes G51 and G52, and a sixth grid G6. Three electron beam holes are formed in each of those grids, so as to respectively correspond to the three cathodes K disposed in line.

In this electron gun assembly, a voltage of about 100 to 150V is supplied to the cathodes K. The first grid G1 is grounded. The second grid G2 is applied with a voltage of about 6 to 8 kV and the third grid G3 is applied with a voltage of about 6 to 8 kV. The fourth grid is connected to the second grid G2 and is applied with a voltage of about 500 to 800V. The first segment electrode G51 of the fifth grid G5, which is adjacent to the fourth grid G4, is connected to the third grid G3 and is supplied with a voltage of about 6 to 8 kV. The second segment electrode G52 of the sixth grid G6, which is adjacent to the sixth grid G6, is applied with a dynamic voltage Vf+Vd obtained by superimposing a parabolic voltage Vd on a voltage Vf. This parabolic voltage Vd increases in accordance with deflection of the electron beams. The sixth grid G6 is supplied with a high voltage of about 26 to 27 kV, i.e., an anode voltage.

By voltages as described above, electron beams are generated by the cathodes K and first and second grid G1 and G2, and object points are formed relative to a main lens, which will be described later, (i.e., triad portion forming cross-over points). A pre-focus lens for preliminarily converging the electron beams from the triad portion is formed by the second and third grids G2 and G3. A sub-lens for further converging the electron beams preliminarily focused by the pre-focus lens is formed by the third and fourth grids G3 and G4 and the first segment electrode G51 of the fifth grid G5. A main lens for finally converging the electron beams onto the phosphor screen is formed by the second segment electrode G52 of the fifth grid G5 and the sixth grid G6. Further, a quadruple lens which dynamically changes in accordance with deflection of the electron beams is formed by the two segment electrodes G51 and G52.

When electron beams extend toward the center of the phosphor screen without being deflected, the voltage applied to the second segment electrode G52 is a potential of about 6 to 8 kV; substantially equal to the potential of the first segment electrode G51, so that no quadruple lens is formed. However, when the voltage applied to the second segment electrode G52 is increased as electron beams are deflected, a quadruple lens is formed, and simultaneously, the intensity of the main lens is weakened. As a result, the distance from the electron gun assembly to the phosphor screen is increased, and the magnification of the lens is changed so as to correspond to such an increased distance to an imaging point, while the deflection aberration is compensated for by a non-uniform magnetic field consisting of a pin-cushion type horizontal deflection magnetic field generated by the deflection device and a barrel type vertical deflection magnetic field.

So that the color cathode ray tube apparatus obtains an excellent image quality, it is necessary to obtain an excellent focusing characteristic on the phosphor screen. In general, in an in-line type color cathode ray tube apparatus in which three electron beams are emitted. As shown in FIG. 2, a haze 3 appears in the vertical (or V-axis) direction of a beam spot 2 that appears in a peripheral portion of the screen 1 due to the deflection aberration as described above. However, the haze 3 caused by the deflection aberration in the vertical direction of the beam spot 2 in the peripheral portion of the screen 1 can be eliminated if the structure is arranged such that the fifth grid forming a lower voltage side electrode of the main lens is divided so as to form a quadruple lens, as in a double focus method electron gun apparatus as described above.

However, in this double focus method electron gun apparatus, it is not possible to eliminate a phenomenon where a beam spot 2 in the peripheral portion of the screen 1 is collapsed so as to be elongated laterally, as shown in FIG. 3 with respect to the beam spot 2 at an end of the horizontal axis (or the H-axis) and at an end of the diagonal axis (or D-axis). This leads to a problem that laterally elongated beam spot 2 interferes with the electron beam path holes in the shadow mask, thereby generating a moire, so that it is difficult to view letters imaged on the screen.

As a means for solving the problem of the phenomenon that the beam spot 2 in the peripheral portion of the screen 1, an electron gun assembly has been proposed in which a laterally elongated through-hole is formed in the surface of the second grid which faces the third grid.

If such a laterally elongated through-hole is formed in the second grid, the horizontal diameter of the object points can be reduced and lateral collapsing of beam spots at the ends of the horizontal axis and diagonal axis is softened. (Thus, a moire is generated by an interference with electron beam holes at the ends of the horizontal axis and the diagonal axis of the screen. However, since the means of forming a laterally elongated through-hole in the second grid statically corrects the diameter of the object points, the electron beams extending toward the center of the phosphor screen have a longitudinally elongated shape. In addition, since the diverging angle of electron beams in the horizontal direction is enlarged, a haze easily appears in the horizontal direction so that the resolution in the center portion of the screen is degraded. In addition, the effect of softening the lateral collapsing is insufficient. In this kind of electron gun, the degree of freedom in designing the second grid is limited, so that it is necessary to make a fine adjustment to the depth of the groove for controlling the shape of the beam spot on the screen. Further, since a laterally elongated groove is formed in the electron beam holes, the structure of the electrodes is complicated so that high processing precision is required for forming the electron beam holes and the through-hole. As a result, it is difficult to reduce variations of the shapes of the beam spots.

In addition, Japanese Patent Application KOKAI Publication No. 60-81736 discloses an electron gun assembly in which a longitudinally elongated groove is formed in the surface of a third grid which faces a second grid, and the diameter of object points and the emission angle are statically corrected to soften lateral collapsing of beam spots at the peripheral portion of the screen.

However, this kind of electron gun assembly easily causes a haze in the horizontal direction, as in the above case where a laterally elongated through-hole is formed in the second grid. Therefore, the effect of softening the lateral collapsing is insufficient. Further, the degree of freedom in designing the third grid is reduced so that it is necessary to make a fine adjustment of the depth of the groove for controlling the shapes of the beam spots on the screen. Furthermore, since a longitudinally elongated through-hole is provided for electron beam holes, the structure of the electrode is complicated so that high processing precision is required for forming the electron beam holes and the groove. As a result, it is difficult to reduce variations in shapes of beam spots.

Japanese Patent Application KOKAI Publication No. 3-95835 and a corresponding U.S. patent thereof, issued as U.S. Pat. No. 5,061,881, discloses an electron gun assembly with a structure in which a convergence electrode of a BPF type electron gun assembly is divided into four sections, to form first and second quadruple lenses having opposite polarities. The lateral collapsing of beam spots in the peripheral portion of the phosphor screen is reduced in a manner in which the first quadruple lens is arranged so as to have an effect of diverging electron beams in the horizontal direction and converging the electron beams in the vertical direction, while the second quadruple lens is arranged so as to have an effect of converging the electron beams in the horizontal direction and diverging the electron beams in the vertical direction.

However, in this kind of electron gun assembly, electron beams injected into the main lens have a large horizontal diameter due to the effects of the two quadruple lenses, and the gun assembly easily receives an influence from the spherical aberration of the main lens, so that the resolution is degraded in the peripheral portion of the phosphor screen. In particular, the influence from the spherical aberration of the main lens is large within a range where a large current flows, so that the resolution is greatly degraded.

Japanese Patent Application KOKAI Publication No. 6-162958 discloses an electron gun assembly for reducing the spherical aberration of the main lens, in which an electron gun which weakens the convergence effect in the horizontal direction more than in the vertical direction, with the main lens used as a non-symmetrical lens.

However, in order to obtain beam spots having a true circular shape in the peripheral portion of the phosphor screen, the diameter of electron beams must be considerably elongated in the lateral direction when the electron beams pass through the main lens. Therefore, the spherical aberration of the main lens cannot be sufficiently reduced within a range where a large current flows.

As described above, in order to achieve a color cathode ray tube apparatus with an excellent resolution, influences from deflection aberration must be reduced as much as possible, and beam spots on the screen must be arranged to have a true circular shape and a size as small as possible.

As for requirements as described above, a conventional QPF type double focus method electron gun assembly is capable of compensating for the deflection aberration by forming a quadruple lens, but cannot solve the problem of lateral collapsing of beam spots in the peripheral portion of the screen.

An electron gun assembly which softens the lateral collapsing of beam spots has been proposed in which a laterally elongated groove is formed in the surface of the second grid, which faces the third grid. This electron gun assembly statically corrects the diameter of object points, and, therefore, the cross-section of the electron beam extending toward the center of the phosphor screen has a longitudinally elongated cross-section. In addition, the divergence angle of the electron beams in the horizontal direction is widened, so that a haze easily appears in the horizontal direction and the resolution is degraded in the center portion of the screen. The effect of softening lateral collapsing is also insufficient. Further, the degree of freedom in designing the second grid is low so that the structure of the electrode is complicated and the shapes of beam spots on the screen vary.

In addition, another electron gun assembly has been proposed in which diameters of object points and the diverging angle are statically corrected thereby to soften lateral collapsing of beam spots in the peripheral portion of the screen. In this electron gun assembly, the diverging angle of the electron beams in the horizontal direction is enlarged so that a haze easily occurs in the horizontal direction and the effect of softening the lateral collapsing is insufficient. Further, the degree of freedom in designing the third grid is low and the structure of the electrode is complicated. As a result, shapes of beam spots on the screen easily vary.

As an electron gun assembly for solving the problem as described above, an electron gun assembly has been proposed in Japanese Patent Application KOKAI Publication No. 3-95835, which has a structure in which a convergence electrode of a BPF type electron gun assembly is divided into four sections, to form first and second quadruple lenses having opposite polarities. The lateral collapsing of beam spots in the peripheral portion of the phosphor screen is reduced in a manner in which the first quadruple lens is arranged so as to have an effect of diverging electron beams in the horizontal direction and converging the electron beams in the vertical direction, while the second quadruple lens is arranged so as to have an effect of converging the electron beams in the horizontal direction and diverging the electron beams in the vertical direction. However, in this kind of electron gun assembly, electron beams injected into the main lens have a large horizontal diameter due to the effects of two quadruple lenses, and the gun assembly easily receives an influence from the spherical aberration in the main lens, so that the resolution is degraded in the peripheral portion of the phosphor screen. In particular, the influence from the spherical aberration is large within an area where a large current flows, so that the resolution is greatly degraded.

An electron gun assembly for reducing the spherical aberration of the main lens has also been proposed in which an electron gun weakens the convergence effect in the horizontal direction more than in the vertical direction, with the main lens used as a non-symmetrical lens. However, in order to obtain beam spots having a true circular shape in the peripheral portion of the phosphor screen, the diameter of electron beams must be considerably elongated in the lateral direction when the electron beams pass through the main lens. Therefore, this electron gun assembly has a problem in that the spherical aberration of the main lens cannot be sufficiently reduced.

SUMMARY OF THE INVENTION

The present invention has been made in order to solve the above problem, and has an object of providing an electron gun assembly for a color cathode ray tube in which beam spots on the entire area of the screen are each shaped to be true circles so that an excellent resolution is obtained.

According to the present invention, there is provided an electron gun assembly of a color cathode ray tube apparatus, for generating three electron beams, which are deflected in horizontal and vertical directions by a deflection yoke provided on the tube apparatus to scan a phosphor screen in the tube apparatus, comprising: means for emitting the three electron beams; means for forming crossover points of the emitted electron beams, respectively, which includes control and screen grids arranged between the emitting means and the phosphor screen; means for forming a main lens system for focusing the electron beams diverged from the cross-over points to the phosphor screen, which includes first, second, third, fourth, and fifth grids arranged between the forming means and the screen and an additional grid arranged between the screen grid and the first grid; and means for applying a constant focus voltage, to the first and third grids, for applying a dynamic voltage to the fourth grid and the additional grid, the dynamic voltage being varied depending on the deflection of the electron beams, and for applying a grid voltage to the second grid and one of the control and screen grids, whereby a plurality of first quadruple electron lenses corresponding to the three electron beams are formed between the third and fourth grids, each of which has a first lens power which is changed depending on the deflection of the electron beams, and whereby a plurality of second quadruple electron lenses corresponding to the three electron beams are formed between the additional grid and the first grid, each of which has a second lens power which is changed depending on the deflection of the electron beams, and whereby a plurality of sub-lenses corresponding to the three electron beams are formed between the first grid and the fourth grid, each of which has a convergent lens power for converging the corresponding electron beam in the vertical and horizontal directions.

Further, according to the present invention, there is provided an electron gun assembly of a color cathode ray tube apparatus, for generating three electron beams which are deflected in horizontal and vertical directions by a deflection yoke provided on the tube apparatus to scan a phosphor screen in the tube apparatus, comprising: means for emitting the three electron beams; means for forming crossover points of the emitted electron beams, respectively, which includes control and screen grids arranged between the emitting means and the phosphor screen; means for forming a main lens system for focusing the electron beams diverged from the cross-over points to the phosphor screen, which includes first, second, third, fourth, and fifth grids arranged between the forming means and the screen and an additional grid arranged between the screen grid and the first grid; and means for applying a constant focus voltage to the additional grid and third grid, for applying a dynamic voltage to the first and the fourth grids, the dynamic voltage being varied depending on the deflection of the electron beams, and for applying a grid voltage to the second grid and one of the control and screen grids, whereby a plurality of first quadruple electron lenses corresponding to the three electron beams are formed between the third and fourth grids, each of which has a first lens power which is changed depending on the deflection of the electron beams, whereby a plurality of second quadruple electron lenses are formed between the additional grid and the first grid, each of which has a second lens power which is changed depending on the deflection of the electron beams, and whereby a plurality of sub-lenses corresponding to the three electron beams are formed between the first grid and the fourth grid, each of which has a convergent lens power for converging the corresponding electron beam in the vertical and horizontal directions.

Also, according to the present invention, there is provided an electron gun assembly of a color cathode ray tube apparatus, for generating electron beams which are deflected in horizontal and vertical planes by a deflection yoke provided on the tube apparatus to scan a phosphor screen in the tube apparatus, comprising: means for emitting the three electron beams; first forming means for forming crossover points of the emitted electron beams; second forming means for forming first quadruple electron lenses corresponding to the three electron beams, each of which has a first horizontal lens power for diverging the corresponding electron beam in the horizontal plane and a first vertical lens power for converging the corresponding electron beam in the vertical plane, the first horizontal and vertical lens powers being varied depending on the deflection of the electron beams; third forming means for forming sub-lenses corresponding to the three electron beams, each of which has horizontal and vertical convergent lens powers for converging the corresponding electron beam in the horizontal and vertical planes; fourth forming means for forming second quadruple electron lenses corresponding to the three electron beams, each of which has a second horizontal lens power for converging the corresponding electron beam in the horizontal plane and a second vertical lens power for diverging the corresponding electron beam in the vertical plane, the second horizontal and vertical lens powers being varied depending on the deflection of the electron beams; and fifth forming means for forming main lenses, each of which has a focusing lens power for focusing the corresponding electron beam onto the screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 7 and 8 are views for explaining changes in dynamic voltage applied to the electron gun assembly shown in FIG. 5 from a voltage source;

DETAILED DESCRIPTION OF THE PREFERRED EMBODIMENTS

In the following, embodiments of the color cathode ray tube apparatus according to the present invention will be explained.

Figure 1:
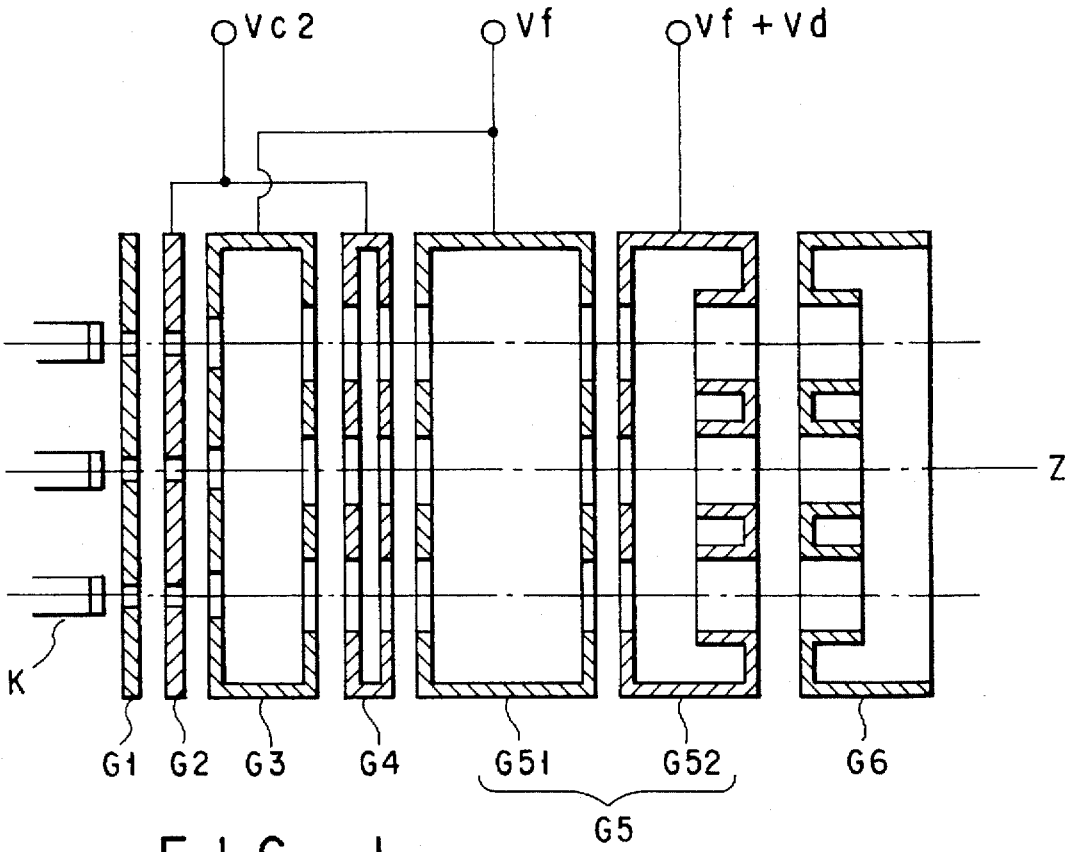
FIG. 1 is a view schematically illustrating a structure of an electron gun assembly of an QPF type double focus method in a conventional in-line type color cathode ray tube apparatus.
Figure 2:
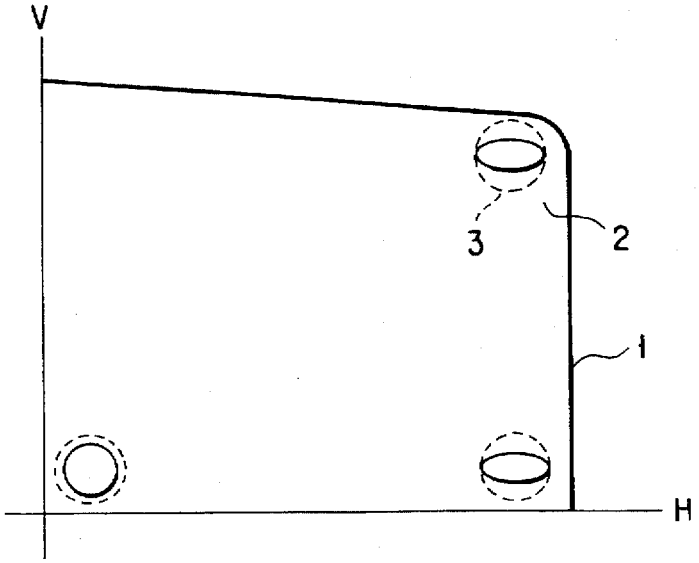
FIG. 2 is a view illustrating shapes of beam spots at peripheral portions of the screen of a conventional in-line type color cathode ray tube.
Figure 3:
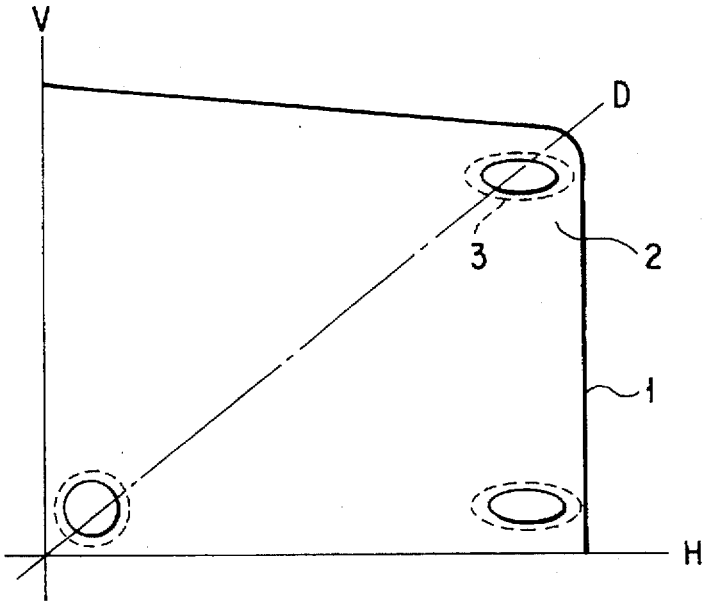
FIG. 3 is a view illustrating shapes of beam spots at peripheral portions of the screen of a conventional in-line type color cathode ray tube, where an electron gun assembly of a QPF type double focus method is used.
Figure 4:
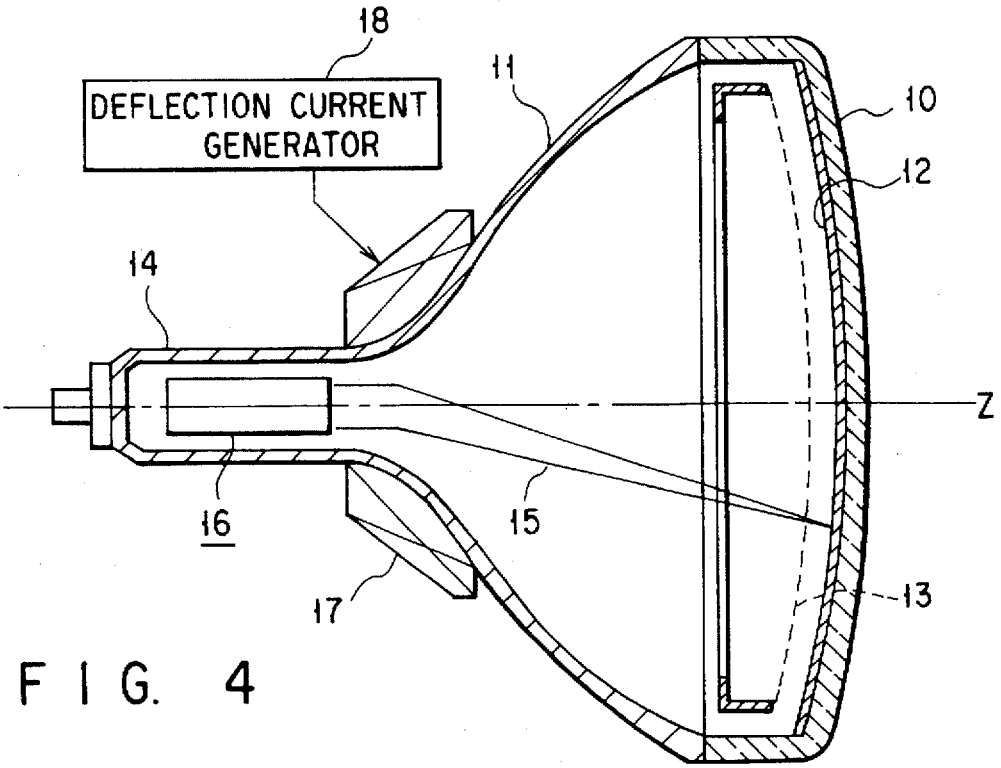
FIG. 4 is a cross-section schematically showing a color cathode ray tube apparatus according to an embodiment of the present invention.

FIG. 4 shows a color cathode ray tube apparatus according to an embodiment of the present invention. This color cathode ray tube apparatus comprises a panel 10 and an envelope formed of a funnel 11 integrally connected with the panel 10. A phosphor screen 12 consisting of three color phosphor layers for emitting dotted light in three colors of blue, green, and red is provided on the inner surface of the panel 10, and a shadow mask 13 is provided inside the screen 12, so as to face the screen 12. On the other side, an electron gun assembly 16 is provided in a neck 14 of the funnel 11, to emit electron beams 15 arranged in line and consisting of a center beam and a pair of side beams which pass on a same horizontal plane. Further, the three electron beams 15 are deflected by horizontal and vertical magnetic fields generated by a deflection device provided outside the funnel 11, to horizontally and vertically scan the phosphor screen 12, thereby displaying a color image. The deflection device 17 generates horizontal and vertical deflection magnetic fields by means of a horizontal deflection current and a vertical deflection current both generated by the deflection current generator 18.

Figure 5:
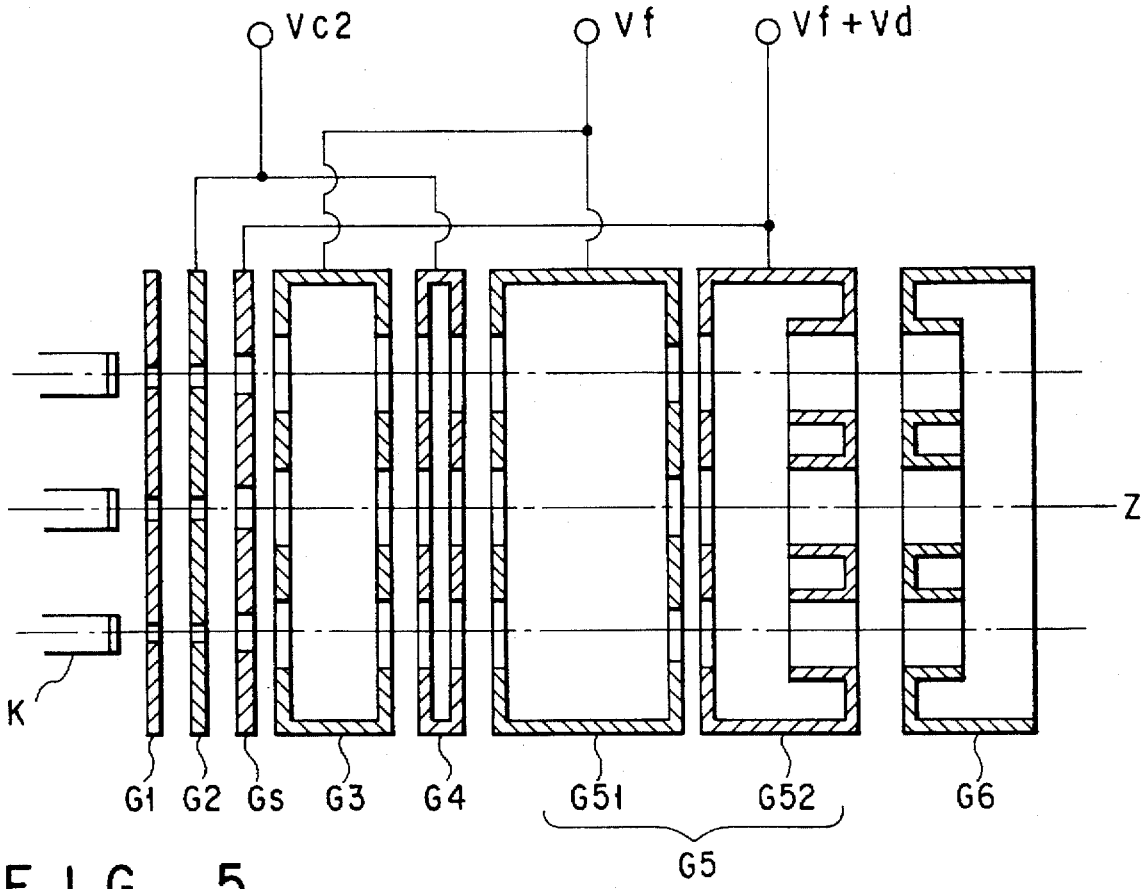
FIG. 5 is a view schematically showing the structure of an electron gun assembly shown in FIG. 4.
Figure 6:
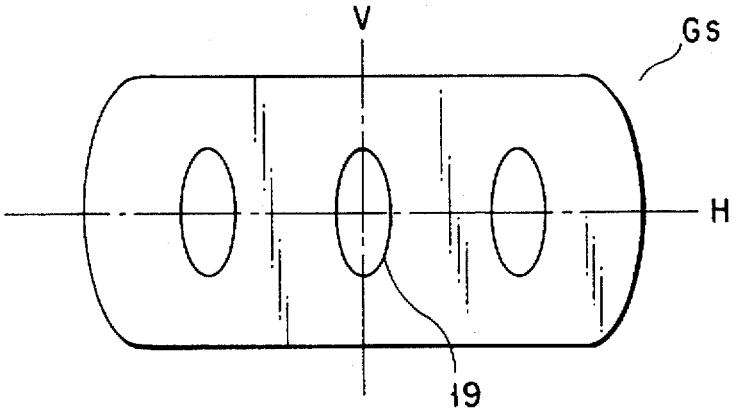
FIG. 6 is a view showing shapes of beam holes of an additional grid in the electron gun assembly shown in FIG. 5.

The electron gun assembly 16 is a QPF type double focus electron gun assembly, and comprises three cathodes K disposed in line in the horizontal (or H-axis) direction, three heaters (not shown) for respectively heating the cathodes K, a first grid G1, a second grid G2, a third grid G3, a fourth grid G4, a fifth grid G5 consisting of first and second segment electrodes G51 and G52, and a sixth grid G6, such that these components are disposed in this order toward the phosphor screen from the cathodes K, as shown in FIG. 5. The cathodes K, the heaters, the first to fourth grids G1 to G4, the first and second segment electrodes G51 and G52 of the fifth grid G5, and the sixth grid are integrally fixed to a pair of insulating support members (not shown) through a support portion.

In this electron gun assembly 16, an additional grid Gs is provided between the second and third grids G2 and G3, and is integrally fixed together with the other electrodes, to the insulating support members.

Each of the first and second grids G1 and G2, and the additional grid Gs is formed of a plate-like electrode having a one-body structure and a major axis extending in the horizontal direction. Each of the third grid G3, the fourth grid G4, the first segment electrode G51 of the fifth grid G5 positioned in the side thereof close to the fourth grid G4, and the second segment electrode G52 of the fifth grid G5 positioned in the side thereof close to the sixth grid G6 is formed of a cylindrical electrode having a one-body structure and a major axis extending in the horizontal direction.

Three electron beam holes of a relatively small size disposed in line in the horizontal direction are formed in each of the first and second grids G1 and G2, so as to correspond to three cathodes K. Further, three electron beam holes disposed in line in the horizontal direction so as to correspond to the three cathodes K are formed in each of the third and fourth grids G3 and G4, the first and second segment electrodes G51 and G52 of the fifth grid G5, and the surface of the sixth grid G6 facing an adjacent grid. In particular, in the surface of the first segment electrode G51 of the fifth grid G5 facing the second segment electrode G52, three electron beam holes disposed in line in the horizontal direction are each formed so as to have a major axis extending in the vertical direction. In the surface of the second segment electrode G52 facing the first second segment electrode G51, three electron beam holes disposed in line in the horizontal direction are each formed so as to have a major axis extending in the horizontal direction. In addition, in the additional grid Gs, three electron beam holes 19 each having a major axis extending in the vertical or V-axis direction and each having a longitudinal shape are formed and disposed in line in the horizontal direction, so as to correspond to the three cathodes K.

In this electron gun assembly, the cathodes K are applied with a voltage obtained by superimposing a video signal corresponding to an image, on a direct current voltage of about 100 to 150V. The first grid G1 is grounded, and the second and fourth grids G2 and G4 are applied with a voltage Vc2 of about 500 to 800V from a voltage source (not shown). The additional grid Gs and the second segment electrode G52 of the fifth grid G5 are connected to each other in the tube apparatus. The additional grid Gs and the second segment electrode G52 of the fifth grid G5 are applied with a dynamic voltage (Vf+Vd) from a voltage source (not shown). The dynamic voltage (Vf+Vd) is obtained by superimposing a parabolic voltage Vd, which increases in accordance with a deflection amount of the electron beams, on a direct voltage Vf of about 6 to 8 kV, as shown in FIGS. 7 and 8. The third grid G3 and the first segment electrode G51 of the fifth grid G5 are connected to each other in the tube apparatus, and the third grid G3 and the first segment electrode G51 of the fifth grid G5 are supplied with a direct current of about 6 to 8 kV as described above, from the voltage source (not shown). The sixth grid G6 is applied with a high voltage (or anode voltage) of about 26 to 27 kV from the voltage source (not shown).

FIG. 7 shows time-based changes in the dynamic voltage (Vf+Vd). In FIG. 7, PV denotes one cycle of vertical deflection, and PH denotes one cycle of horizontal deflection. As is apparent from FIG. 7, the dynamic voltage (Vf+Dd) changes, depending on the vertical deflection and the horizontal deflection direct current generated by the deflection current generator 18, within cycles PV and Ph of vertical deflection and the horizontal deflection. FIG. 8 shows enlarged changes in the dynamic voltage (Vf+Vd) of the horizontal deflection shown in FIG. 7, within a cycle of the horizontal deflection and the vertical deflection, and the lateral axis represents a position to which a beam is directed on the screen 3. References SPa and SPb respectively denote peripheral portions of the screen, and a reference SC0 denotes the center portion of the screen. The graph I in FIG. 8 indicates changes in the dynamic voltage (Vf+Vd) in case where the screen is scanned with beams along the horizontal direction. The graph II indicates changes in the dynamic voltage (Vf+Vd) in cases where the screen is scanned with beams along the vertical direction. As is apparent from FIG. 8, the dynamic voltage (Vf+Vd) changes as beams are deflected along the vertical direction on the screen. This dynamic voltage is the highest at the peripheral portions SPa and SPb, while the dynamic voltage is the lowest at the center portion SC0. Likewise, the dynamic voltage (Vd+Vd) changes as beams are deflected along the horizontal direction on the screen. This dynamic voltage also is the highest at the peripheral portions SPa and SPb, while the dynamic voltage is the lowest at the center portion SC0. Therefore, the dynamic voltage (Vf+Vd) is the highest at corners of the screen, and is the lowest at the center portion SC0, on the entire screen.

Figure 9:
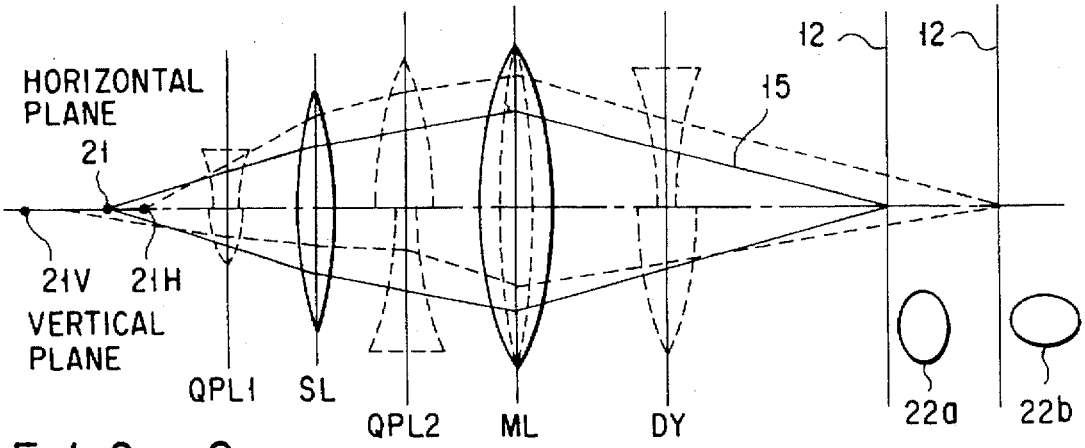
FIG. 9 is a view for explaining operation of electron lenses formed by the electron gun assembly shown in FIG. 5.

By voltages as described above, electron beams are generated and trade portion forming object points are formed on with respect to the main lens, by the cathodes K and the first and second grid G1 and G2, as shown in FIG. 9. A lens QPL1 having quadruple components, which change in accordance with deflection of the electron beams, is formed by the third grid G3 and the additional grid Gs, and a sub-lens SL for preliminarily converging the electron beams emitted from the cathodes K is formed by the third and fourth grids G3 and G4 and the first segment electrode G51 of the fifth grid G5. A main lens ML for finally converging the electron beams onto the phosphor screen is formed by the second segment electrode G52 of the fifth grid G5 and the sixth grid G6. In addition, a quadruple lens QPL2, which changes in accordance with deflection of the electron beams, is formed between the sub-lens and the main lens, by the first and second segment electrodes G51 and G52 of the fifth grid G5. In FIG. 9, DY denotes a magnetic field lens formed by a deflection magnetic field generated from a deflection device 17, and the electron beams are supplied with aberration by the magnetic field lens DY.

By thus forming electron lenses, electron beams 15 extend in the following manner, from the object points and the cross-over points 21 to the phosphor screen 12, as indicated by continuous lines in FIG. 9, in cases where the electron beams are not deflected by deflection magnetic fields generated from the deflection device. At first, the electron beams 15 from the triode portion are preliminarily converged in the horizontal and vertical directions by a pre-focus lens formed by the second and third grids G2 and G3. Thereafter, the electron beams are preliminarily converged in the vertical and horizontal directions, by the sub-lens SL formed by the third and fourth grids G3 and G4 and the first segment electrode G51 of the fifth grid G5. Finally, the electron beams are properly converged in the horizontal and vertical directions, onto the center of the phosphor screen 12, i.e., onto the center of the screen, by the main lens ML formed by the second segment electrode G52 of the fifth grid G5 and the sixth grid G6, so that the beam spot 22*a* is substantially shaped like a true circle.

In contrast, in case, where electron beams are deflected in the horizontal direction by deflection magnetic fields generated from the deflection device, the electron beams extend in the following manner, as indicated by broken lines in FIG. 9. In this case, the electron beams 15 are subjected to divergence in the horizontal direction, i.e., on the horizontal plane, and are subjected to convergence in the vertical direction, i.e., on the vertical plane, by a lens QPL1 which has quadruple components and is formed by the third grid G3 and the additional grid Gs, due to increases in the dynamic voltage (Vf+Vd) applied to the additional grid Gs. As a result of this, the object points in the horizontal direction, i.e., the cross-over points 21H are shifted in the direction toward the phosphor screen 12 while the object points in the vertical direction, i.e., the cross-over points 21V are shifted in the opposite direction, so that the diameters of the cross-points are changed to be longer in the longitudinal direction and the diverging angle of the electron beams 15 is large in the horizontal direction and is small in the vertical direction. Further, the diverging angle of the electron beams is restricted by the sub-lens SL formed by the third and fourth grids G3 and G4 and the first segment electrode G51 of the fifth grid G5. Further, in cases where the electron beams 15 are deflected by deflection magnetic fields generated from the deflection device, a quadruple lens QPS2 is formed by the first and second segment electrodes G51, and G52, of the fifth grid G5, and is subjected to convergence in the horizontal direction and to divergence in the vertical direction. In addition, the convergence effect of the main lens ML formed by the second segment electrode G52 of the fifth grid G5 and the sixth grid G6 is weakened. As a result of this, it is possible to cancel the deflection magnetic fields acting on the electron beams passing through a deflection magnetic field DY, i.e., the lens effect which functions to diverge electron beams in the horizontal direction of the magnetic lens DY and to converge electron beams in the vertical direction. Therefore, a beam spot 22*b* on the phosphor screen 12 can be arranged into a shape substantially equal to a true circle.

The embodiment as described above has been explained with respect to a case in which electron beams are deflected in the horizontal direction. However, the same results as obtained in the above embodiment can be obtained in a case in which the electron beams are deflected in the vertical and diagonal directions.

Therefore, by constructing an electron gun assembly in the structure as described above, the beam spots in the center portion and the peripheral portions of the screen can have shapes substantially equal to true circles, so that the resolution of the entire area of the screen can be improved.

In the electron gun assembly 16 as described above, the diameters of object points of electron beams, i.e., the diameters of the cross-over points can be freely changed by changing the distance between the second grid G2 and the additional grid Gs or the distance between the third grid G3 and the additional grid Gs, so that the design margins can be large. Further, since the structure of the additional grid Gs is simple and therefore can be formed with high precision, variations of the beam spots can be reduced.

Next, an electron gun assembly according to a modified embodiment of the electron gun assembly in FIG. 5 will now be explained with reference to FIGS. 10 and 11.

Figure 10:
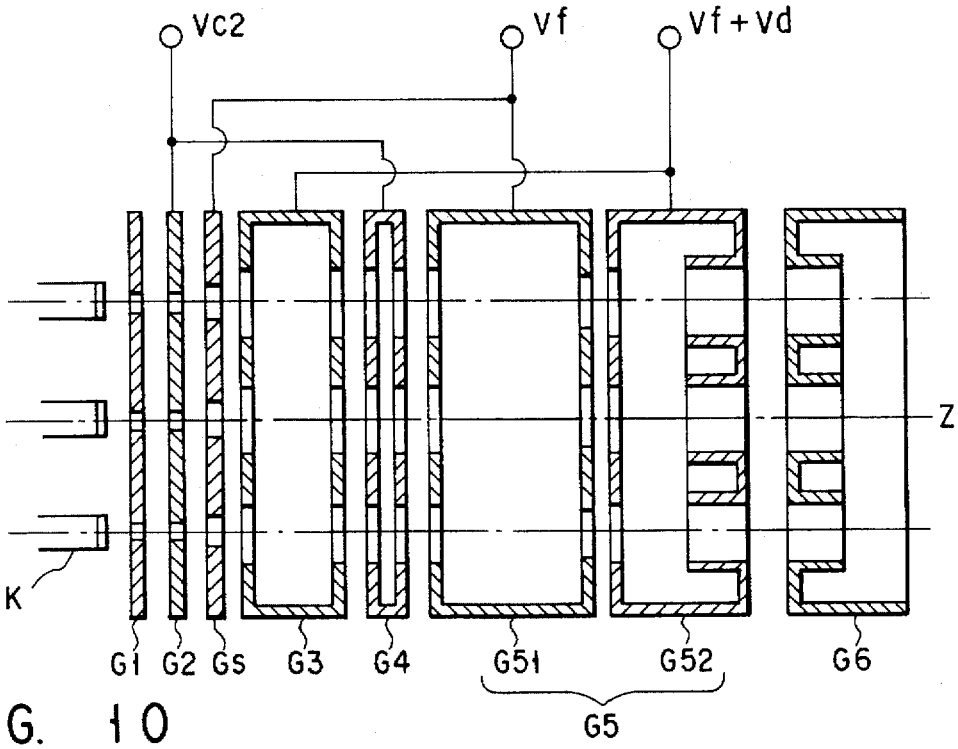
FIG. 10 is a view for schematically showing a structure of an electron gun assembly of a color cathode ray tube apparatus according to another embodiment of the present invention.
Figure 11:
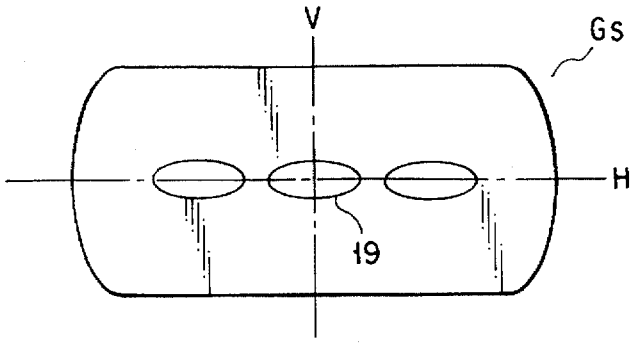
FIG. 11 is a view showing shapes of electron beam holes of the additional grid shown in FIG. 10.

The electron gun assembly shown in FIG. 10 comprises three cathodes K disposed in line in the horizontal direction, three heaters (not shown) for individually heating the cathodes K, first to fourth grids, G1 to G4, disposed in this order from the cathodes K toward the phosphor screen, first and second segment electrodes, G51 and G52, forming the fifth grid G5, a sixth grid G6, and an additional grid Gs provided between the second and third grids, G2 and G3, as in the electron gun assembly shown in FIG. 5. However, this electron gun is arranged such that three electron beam holes 20 of the additional grid Gs, each of which has a laterally elongated shape and a major axis extending in the horizontal direction are formed and disposed in line in the horizontal direction, as shown in FIG. 11.

Further, in this electron gun assembly, the additional grid Gs and the first segment electrode G51 of the fifth grid G5 are connected to each other in the tube apparatus and are applied with a direct current voltage Vf of about 6 to 8 kV from a voltage source (not shown). The third grid G3 and the second segment electrode G52 of the fifth grid G5 are connected to each other in the tube apparatus, and are applied from the voltage source (not shown) with a dynamic voltage (Vf+Vd) obtained by superimposing a parabolic voltage Vd, which increases in accordance with a deflection amount of electron beams, on a direct current voltage of about 6 to 8 kV described above.

In this structure, it is possible to form an electron gun assembly which has the same advantages as those obtained in the electron gun assembly shown in FIG. 5.

As has been described above, this gun assembly comprises a triode portion and a main lens portion. The triode portion consists of cathodes, and control and screen grids disposed in an order from the cathodes toward a phosphor screen. The main lens portion consists of a plurality of grids for converging electron beams emitted from the cathodes. The grids forming the main lens portion are at least first to fourth grids and a final acceleration grid. The first and third grids are applied with a constant focus voltage, and the fourth grid is applied with a dynamic voltage obtained by superimposing a voltage which changes depending on a deflection amount of the electron beams on the focus voltage. The second grid is applied with a voltage substantially equal to one of those grids which form the triode portion. A means which changes in accordance with the deflection amount of the electron beams is provided at least on one of the surfaces of the third and fourth grids facing each other. In this an electron gun assembly for a color cathode ray tube, if an additional grid connected to the fourth grid is provided between the screen grid and the first grid and if a means for forming a quadruple lens which changes in accordance with the deflection amount of the electron beams is provided at least on one of the surfaces of the additional grid and the first grid facing each other, then beam spots having shapes of substantially true circles are formed on the center portion of the screen when the electron beams are not deflected by deflection magnetic fields generated by a deflection device, while beam spots in the peripheral portion of the screen can be shaped in substantially true circles without haze, when the electron beams are deflected by deflection magnetic fields generated by the deflection device. Thus, the resolution can be greatly improved over the entire area of the screen.

Meanwhile, the gun assembly may comprise a triode portion and a main lens portion. The triode portion may consist of cathodes, and control and screen grid grids disposed in an order from the cathodes toward a phosphor screen. The main lens portion may consist of a plurality of grids for converging electron beams emitted from the cathodes. The grids forming the main lens portion may be at least first to fourth grids and a final acceleration grid. The third grid may be applied with a constant focus voltage, and the first and fourth grids may be applied with a dynamic voltage obtained by superimposing a voltage which changes depending on a deflection amount of the electron beams on the focus voltage. The second grid may be supplied with a voltage substantially equal to one of those grids which form the triode portion. A means which changes in accordance with the deflection amount of the electron beams may be provided at least on one of the surfaces of the third and fourth grids facing each other. This electron gun assembly for a color cathode ray tube can have the same advantages as described above, if an additional grid connected to the third grid is provided between the screen grid and the first grid and if a means for forming a quadruple lens which changes in accordance with the deflection amount of the electron beams is provided at least on one of the surfaces of the additional grid and the first grid facing each other.

Further, an example of a color cathode ray tube apparatus according to another embodiment of the present invention will be explained in the following, with reference to FIGS. 12 to 14.

Figure 12:
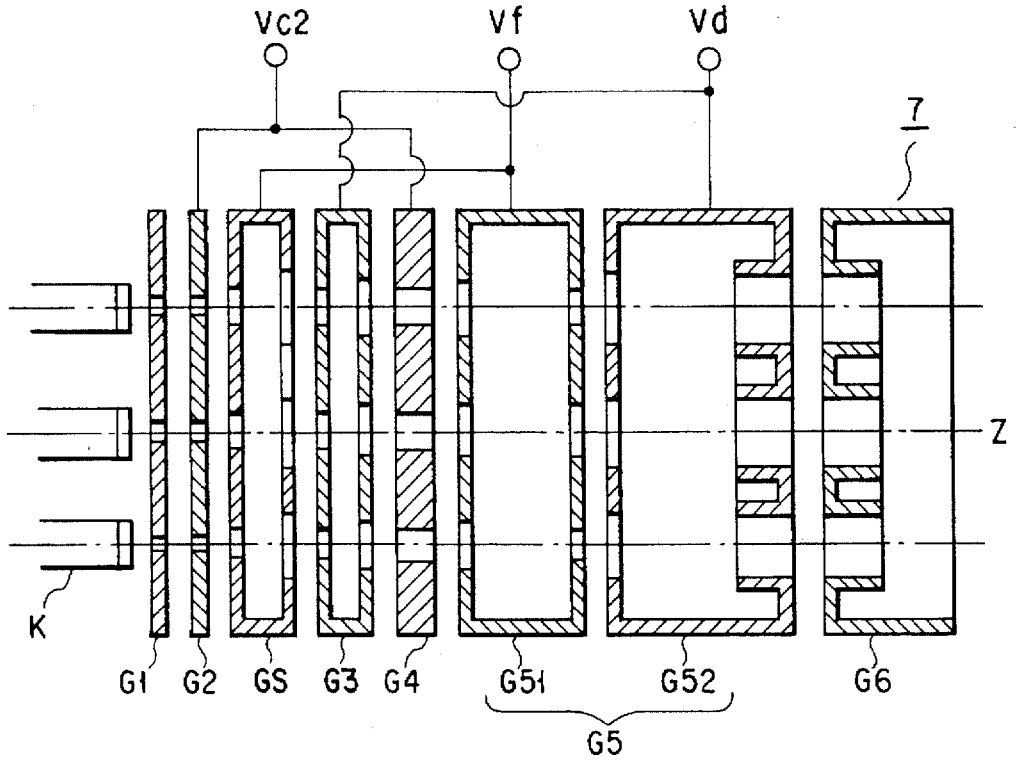
FIG. 12 is a view schematically showing a structure of an electron gun assembly of a cathode ray tube apparatus according to another embodiment of the present invention.
Figure 13:
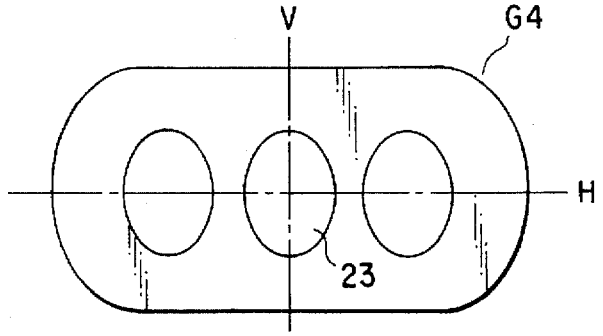
FIG. 13 is a view showing second grid 64 of the electron gun assembly shown in FIG. 12.

An electron gun assembly 16 shown in FIG. 12 is also of a QPF type double focus method. As is shown in FIG. 12, this gun assembly 16 comprises three cathodes K disposed in line in the horizontal (or H-axis) direction, three heaters for respectively heating the cathodes K, a control grid (or a first grid G1), a screen grid (or a second grid G2), a focus grid unit GS, G3, fourth grid G4 and fifth grid G5, and a final acceleration grid (or a grid G6), disposed in this order from the cathodes K toward the phosphor screen. In this embodiment, the focus grid unit Gs and G3 consists of additional grid Gs and third grid, and the fifth grid G5 also consists of two segment grids G51 and G52. These grids G5, G3, G4 G51 and G52 are disposed in this order from the screen gird G2 toward the finale acceleration grid G6.

Each of the additional, third and fifth grids Gs, G3, G51 and G52 is formed of a cylindrical electrode of one-body structure having a major axis in the horizontal direction in which the cathode K are arranged. The additional grid Gs has three electron beam holes which face to the screen grid G2 and are disposed in the horizontal direction so as to respectively correspond to the three cathodes K. The additional grid Gs also has three non-circular electron beam holes which face the third grid G3 and are disposed in the horizontal direction so as to respectively corresponds to the three cathodes K. Each of the non-circular electron beam holes faced to the third grid G3 is formed into a rectangular or elliptic shape having a major axis extending in the horizontal direction. The third grid G3 also has three non-circular electron beam holes which face the additional grid Gs and are disposed in the horizontal direction so as to respectively correspond to the three cathodes K. Each of the non-circular electron beam holes face the additional grid Gs is formed into a rectangular or elliptic shape having a major axis extending in the vertical direction.

The fifth segment grid G51 has three electron beam holes which face the fourth grid G4 and are disposed in the horizontal direction so as to respectively correspond to the three cathodes K. The fifth segment grid G51 also has three non-circular electron beam holes which face the fifth segment grid G52 and are disposed in the horizontal direction so as to respectively correspond to the three cathodes K. Each of the non-circular electron beam holes facing the third grid G3 is formed into a rectangular or elliptic shape having a major axis extending in the vertical direction. The fifth segment grid G52 also has three non-circular electron beam holes which face the fifth segment grid G51 and are disposed in the horizontal direction so as to respectively corresponds to the three cathodes K. Each of the non-circular electron beam holes facing the fifth segment grid G51 is formed into a rectangular or elliptic share having a major axis extending in the horizontal direction. The fifth segment grid G52 also has three non-circular electron beam holes which face the sixth segment grid G6 and are disposed in the horizontal direction so as to respectively correspond to the three cathodes K.

The final acceleration grid G6 is formed of a cup-like electrode of one-body structure which has a major axis in the direction in which the cathodes K are disposed, and three electron beam holes are formed and disposed in line in the horizontal direction, in the bottom portion of the grid G6 which faces the grid G52, so as to correspond to the three cathodes K.

The fourth grid G4 is formed of a plate-like electrode of one-body structure having a major axis in the direction in which the cathodes K are disposed. As shown in FIG. 13, non-circular electron beam holes 23 each having a rectangular or elliptic shape having a major axis in the vertical or V-axis direction are formed in the plate surfaces of the electrode G4, so as to correspond to the three cathodes. For example, elliptic holes are formed and disposed in line in the horizontal or H-axis direction.

In this electron gun assembly 16, the additional grid GS and the fifth segment grid G51 are connected to each other in the tube apparatus, and are applied with a constant focus voltage Vf from a voltage source (not shown). The third grid G3 and the segment grid G52 are connected to each other in the tube apparatus, and are applied with a dynamic focus voltage (Vf+Vd) as has been explained before, from a voltage source (not shown). In addition, the fourth grid G4 is connected to the screen grid G2 in the tube apparatus, and these grids G2 and G4 are applied with a constant voltage Vc2 from a voltage source (not shown).

Figure 14:
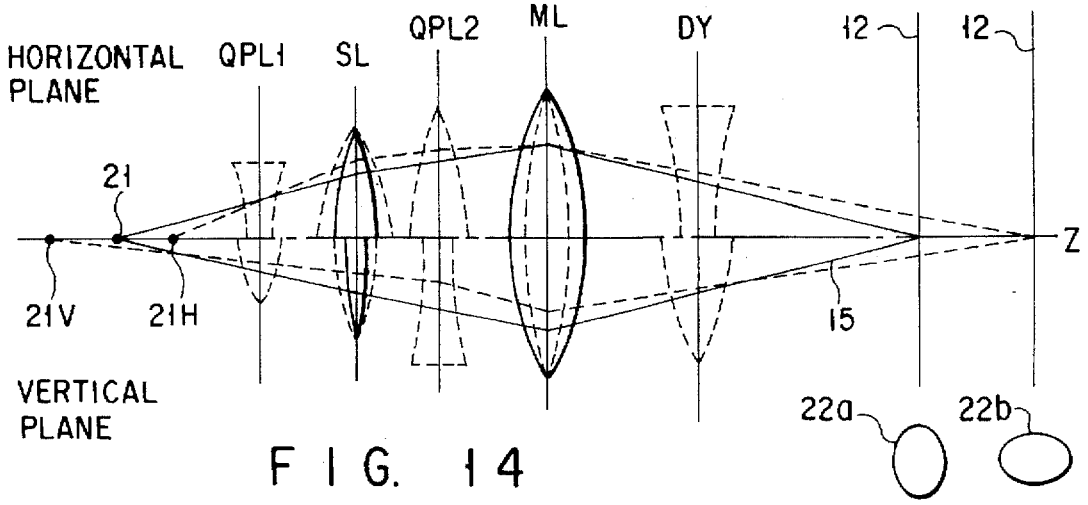
FIG. 14 is a view for explaining operation of electron lenses formed by the electron gun assembly shown in FIG. 12.

By voltages as described above, in this electron gun assembly 16, electron beams are generated and a triode portion for forming object points or cross-over points with respect to a main lens portion ML is formed by the cathodes K, the control grid G1, and the screen grid G2, as shown in FIG. 14. The main lens portion ML is formed by the grids G5, G3, G51, and G52 of the third and fifth grids G3 and G5, the fourth grid G4, and the final acceleration grid G6. A first quadruple lens QPL1 for diverging electron beams in the horizontal direction and converging electron beams in the vertical direction is formed in the main lens portion ML, by the segment grids G5 and G3. A second quadruple lens for converging the electron beams in the horizontal direction and diverging the electron beams in the vertical direction is formed by the segment grids G51 and G52. In addition, a lens which converges the electron beams more strongly in the horizontal direction than in the vertical direction is formed by the segment grid G3, the fourth grid G4, and the segment grid G51. Further, a main lens ML for finally converging the electron beams onto the phosphor screen is formed by the segment grid G52 and the final acceleration grid G6.

As shown in FIG. 14 illustrating the behavior of electron beams by the electron lens, first and second quadruple lenses QPL1 and QPL2 are not respectively formed between the segment grids of the third grid and between the segment grids of the fifth grid, when electron beams extend toward the center of the phosphor screen 12 without being deflected. Instead, from object points or cross-over points 21 to the phosphor screen 12, the electron beams receive a convergence effect which is strong in the horizontal direction and is weak in the vertical direction, by a lens SL formed by the fourth grid between the third grid and the segment grids of the fifth grid. Thereafter, the electron beams are finally converged onto the screen 12 by a main lens ML formed by the fifth grid and the final acceleration grid. As a result of this, a beam spot on the phosphor screen 12 is formed as denoted by 22*a* in the figure, and the beam spot is thus just fitted on the phosphor screen 12 both in the horizontal and vertical directions.

In contrast, when electron beams are deflected in the horizontal direction by the deflection device, a first quadruple lens QPL1 is formed between the segment grids of the third grid. In this state, the divergence effect of the first quadruple lens QPL1 in the horizontal direction or the horizontal plane and the convergence effect thereof in the vertical direction or the vertical plane are dynamically strengthened in synchronization with a deflection amount. As a result of this, the object points or cross-over points in the horizontal direction are shifted forwards toward the phosphor screen 12 as indicated by 21H in the figure, while the object points or cross-points in the vertical direction are shifted backwards as indicated by 21V in the figure, so that the cross-over points each have a diameter elongated in the longitudinal direction. In addition, the convergence effect of the lens SL formed by the segment grids of the third grid, the fourth grid, and the fifth segment grid is strengthened in the horizontal direction, so that the divergence effect of the first quadruple lens is canceled and the diverging angle of the electron beams is reduced. Further, a second quadruple lens QPL2 is formed between the segment grids of the fifth grid. The convergence effect of the second quadruple lens QPL2 in the horizontal direction and the divergence effect thereof in the vertical direction are dynamically strengthened in synchronization with a deflection amount. Further, the convergence effect of the main lens ML formed by the fifth segment G52 grid and the final acceleration grid is weakened. Therefore, the electron beams 15 passing through the main lens ML are not easily affected by spherical aberration in the horizontal direction. In addition, when the electron beams pass through the deflection magnetic fields, a deflection aberration produced by a deflection lens (DY) formed of the deflection magnetic fields can be canceled. As a result of this, the beam spot on the peripheral portion of the phosphor screen denoted by 12*a* becomes a substantially true circle as indicated by 22*a* and can thus be reduced to be small.

Note that the same advantages as described above can be obtained when electron beams are deflected in the vertical and diagonal directions. Therefore, by constructing the electron gun assembly 16 as described above, beam spots are true circles and are also small over the entire area of the phosphor screen 12, so that an excellent resolution can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electron gun assembly of a color cathode ray tube apparatus, for emitting electron beams which are deflected in horizontal and vertical directions by a deflection yoke provided on the tube apparatus to scan a phosphor screen in the tube apparatus, comprising:

means for emitting three electron beams;

means for forming cross-over points of the emitted electron beams, respectively, which includes control and screen grids arranged between the emitting means and the phosphor screen;

means for forming a main lens system for focusing the electron beams diverged from the cross-over points to the phosphor screen, which includes first, second, third, fourth, and fifth grids arranged between the forming means and the screen and an additional grid arranged between the screen grid and the first grid; and means for applying a constant focus voltage to the first and third grids, for applying a dynamic voltage to the fourth grid and the additional grid, the dynamic voltage being varied depending on the deflection of the electron beams, and for applying a grid voltage to the second grid and one of the control and screen grids, whereby a plurality of first quadruple electron lenses corresponding to the three electron beams are formed between the third and fourth grids, each of which has a first lens power which is changed depending on the deflection of the electron beams, whereby a plurality of second quadruple electron lenses corresponding to the three electron beams are formed between the additional grid and the first grid, each of which has a second lens power which is changed depending on the deflection of the electron beams, and whereby a plurality of sub-lenses corresponding to the three electron beams are formed between the first grid and the fourth grid, each of which has a convergent lens power for converging the corresponding electron beam in the vertical and horizontal directions.

2. An electron gun assembly of a color cathode ray tube apparatus, according to claim 1, wherein the additional grid has three elongated holes for allowing the three electron beams, respectively, the elongated three holes being arranged in the horizontal direction and each of the holes being elongated in the vertical direction.

3. An electron gun assembly according to claim 1, wherein the first lens power of each first quadruple electron lens includes horizontal and vertical lens powers for converging each of the electron beams in the horizontal plane and diverging each of the electron beams in the vertical plane, respectively, which are changed depending on the deflection of the electron beams, and wherein the second lens power of each second quadruple electron lens includes horizontal and vertical lens powers for diverging each of the electron beams in the horizontal plane and converging each of the electron beams in the vertical plane, respectively, which are changed depending on the deflection of the electron beams.

4. An electron gun assembly of color cathode ray tube apparatus, for generating electron beams which are deflected in horizontal and vertical directions by a deflection yoke provided on the tube apparatus to scan a phosphor screen in the tube apparatus, comprising:

means for emitting three electron beams;

means for forming crossover points of the emitted electron beams, respectively, which includes control and screen grids arranged between the emitting means and the phosphor screen;

means for forming a main lens system for focusing the electron beams diverged from the crossover points to the phosphor screen, which includes first, second, third, fourth, and fifth grids arranged between the forming means and the screen and an additional grid arranged between the screen grid and the first grid; and means for applying a constant focus voltage to the additional grid and third grid, for applying a dynamic voltage to the first and the fourth grids, the dynamic voltage being varied depending on the deflection of the electron beams, and for applying a grid voltage to the second grid and one of the control and screen grids, whereby a plurality of first quadruple electron lenses corresponding to the three electron beams are formed between the third and fourth grids, each of which has a first lens power which is changed depending on the deflection of the electron beams, whereby a plurality of second quadruple electron lenses corresponding to the three electron beams are formed between the additional grid and the first grid, each of which has a second lens power which is changed depending on the deflection of the electron beams, and whereby a plurality of sub-lenses corresponding to the three electron beams are formed between the first grid and the fourth grid, each of which has a convergent lens power for converging the corresponding electron beam in the vertical and horizontal directions.

5. An electron gun assembly of a color cathode ray tube apparatus, according to claim 4, wherein the additional grid has three elongated holes for allowing the three electron beams, respectively, the elongated three holes being arranged in the horizontal direction and each of the holes being elongated in the horizontal direction.

6. An electron gun assembly according to claim 4, wherein the first lens power of each first quadruple electron lens includes horizontal and vertical lens powers for converging each of the electron beams in the horizontal plane and diverging each of the electron beams in the vertical plane, respectively, which are changed depending on the deflection of the electron beams, and wherein the second lens power of each second quadruple electron lens includes horizontal and vertical lens powers for diverging each of the electron beams in the horizontal plane and converging each of the electron beams in the vertical plane, respectively, which are changed depending on the deflection of the electron beams.

7. An electron gun assembly according to claim 6, wherein the sub-lenses are formed by the first, second and third grid, each of which has the convergent lens power, which includes a horizontal lens power for converging the electron beams, and wherein each second quadruple electron lens has the second lens power, which includes a horizontal lens power for substantially canceling the horizontal lens power of the sub-lens depending on the deflection of the electron beams.

8. An electron gun assembly of a color cathode ray tube apparatus, according to claim 6, wherein the second grid has three elongated holes for allowing the three electron beams, respectively, the elongated three holes being arranged in the horizontal direction and each of the holes being elongated in the vertical direction.

9. An electron gun assembly according to claim 6, wherein the convergent lens power of each sub-lens includes horizontal and vertical convergent lens powers, which are differently varied in the horizontal and vertical planes depending on the deflection of the electron beams, the horizontal convergent lens power of the sub-lens being larger than the vertical convergent lens power of the sub-lens.

10. An electron gun assembly of a color cathode ray tube apparatus, for emitting electron beams which are deflected in horizontal and vertical planes by a deflection yoke provided on the tube apparatus to scan a phosphor screen in the tube apparatus, comprising:

means for emitting three electron beams;

first forming means for forming cross-over points of the emitted electron beams;

second forming means corresponding to the three electron beams, each of which has a plurality of first quadruple electron lenses corresponding to the three electron beams, each of which has a first horizontal lens power for diverging the corresponding electron beam in the horizontal plane and a first vertical lens power for converging the electron beam in the vertical plate, the first horizontal and vertical lens powers being varied depending on the deflection of the electron beams;

third forming means for forming a plurality of sub-lenses corresponding to the three electron beams, each of which has horizontal and vertical convergent lens powers for converging the corresponding electron beam in the horizontal and vertical planes;

fourth forming means for forming a plurality of second quadruple electron lenses corresponding to the three electron beams, each of which has a second horizontal lens power for converging the corresponding electron beam in the horizontal plane and a second vertical convergent lens power for diverging the corresponding electron beam in the vertical plane, the second horizontal and vertical lens powers being varied depending on the deflection of the electron beams; and fifth forming means for forming a plurality of main lenses, each of which has a focusing lens power for focusing the corresponding electron beam onto the screen.

11. An electron gun assembly according to claim 10, wherein the focusing lens power of each main lens is varied depending on the deflection of the electron beams.

12. An electron gun assembly according to claim 10, wherein the horizontal and vertical convergent lens powers of each sub-lens are varied depending on the deflection of the electron beams.

13. An electron gun assembly according to claim 10, wherein the horizontal and vertical convergent lens powers of each sub-lens are differently varied in the horizontal and vertical planes depending on the deflection of the electron beams.

14. An electron gun assembly according to claim 10, wherein the sub-lenses are formed by the first, second and third grids, each of which has the horizontal convergent lens power for converging the electron beams, and wherein each second quadruple electron lens has the second horizontal lens power for substantially canceling the horizontal convergent lens power of the sub-lens depending on the deflection of the electron beams.

* * * * *